US012264002B2

(12) United States Patent
Gonzalez Sanchez

(10) Patent No.: US 12,264,002 B2
(45) Date of Patent: Apr. 1, 2025

(54) CLOSING CAP FOR CONTAINERS

(71) Applicant: Jose Francisco Gonzalez Sanchez, Caldes De Montbui (ES)

(72) Inventor: Jose Francisco Gonzalez Sanchez, Caldes De Montbui (ES)

( * ) Notice: Subject to any disclaimer, the term of this patent is extended or adjusted under 35 U.S.C. 154(b) by 0 days.

(21) Appl. No.: 18/292,909

(22) PCT Filed: Jul. 29, 2022

(86) PCT No.: PCT/ES2022/070509
§ 371 (c)(1),
(2) Date: Jan. 28, 2024

(87) PCT Pub. No.: WO2023/007055
PCT Pub. Date: Feb. 2, 2023

(65) Prior Publication Data

US 2024/0262587 A1 Aug. 8, 2024

(30) Foreign Application Priority Data

Jul. 29, 2021 (ES) ..... ES202131582U

(51) Int. Cl.
*B65D 55/16* (2006.01)
*B65D 41/34* (2006.01)

(52) U.S. Cl.
CPC ..... *B65D 55/16* (2013.01); *B65D 41/3447* (2013.01); *B65D 2401/30* (2020.05)

(58) Field of Classification Search
CPC . B65D 55/16; B65D 41/3447; B65D 2401/30
See application file for complete search history.

(56) References Cited

U.S. PATENT DOCUMENTS 4,394,918 A 7/1983 Grussen

FOREIGN PATENT DOCUMENTS

| | | | | |
|---|---|---|---|---|
| EP | 3842358 A1 | 6/2021 | | |
| ES | 1237189 U | 11/2019 | | |
| ES | 1247151 U | 6/2020 | | |
| FR | 3096362 A1 * | 11/2020 | ..... | B65D 41/3447 |

(Continued)

OTHER PUBLICATIONS

Translation of FR 3096362 provided by Espacenet. (Year: 2024).*

(Continued)

*Primary Examiner* — James N Smalley
(74) *Attorney, Agent, or Firm* — Hassan Abbas Shakir; Shakir Law PLLC

(57) ABSTRACT

A closing cap for containers with a threaded neck portion, includes a lower ring coupled to the neck of the container and an upper cap provided internally with a thread to be coupled to the outer threaded neck portion, the upper cap and the lower ring are joined to rotate together. The connection between the upper cap and the lower ring is made by two flexible extensions diametrically opposed to each other, which are formed by a thickening present in the lower ring that includes a grooved portion. The lower edge of the body of the upper cap has a step defining a recessed portion where the extensions are located. In a closed condition, the two extensions are arranged above and parallel to the body of the lower ring. In an open position, the upper end of the extensions acts as a hinge region allowing the upper cap to rotate.

14 Claims, 8 Drawing Sheets

(56) References Cited

FOREIGN PATENT DOCUMENTS

| | | | | |
|---|---|---|---|---|
| WO | 2021099310 | A2 | 5/2021 | |
| WO | WO-2021099358 | A1 * | 5/2021 | ..... B65D 1/0246 |

OTHER PUBLICATIONS

Translation of WO 2021099358 provided by Espacenet. (Year: 2024).*

International Search Report for related patent application PCT/ES2022/070509 prepared by the European Patent Office and mailed Nov. 17, 2022, in English, 3 pgs.

Written Opinion of the International Searching Authority for related patent application PCT/ES2022/070509 prepared by the European Patent Office and mailed Nov. 17, 2022, in English, 6 pgs.

* cited by examiner

CLOSING CAP FOR CONTAINERS

CROSS-REFERENCE TO RELATED APPLICATIONS DESCRIPTION

This application is a national stage under 35 U.S.C. § 371 of PCT patent application PCT/ES2022/070509 filed on 29 Jul. 2022, which is pending and which is hereby incorporated by reference in its entirety for all purposes. PCT/ES2022/070509 claims priority to Spanish Patent Application U202131582 filed on 29 Jul. 2021, which is hereby incorporated by reference in its entirety for all purposes.

OBJECT OF THE INVENTION

The object of the present application is to provide a closing cap for containers. More specifically, the invention proposes the development of a cap provided with an upper cap and a lower ring attached to each other, in such a way that they do not separate during the screwing and/or unscrewing of the cap on a container neck.

BACKGROUND OF THE INVENTION

In the field of packaging food products (solid, liquid, viscous substances, etc.), closing caps made from plastic material have been used for many years, caps which are provided with an inner thread able to be threaded in a cut formed in the neck of the container itself, enabling the contents inside the container to be kept airtight, for example, in the case of a bottle of the type used for bottling beverages, such as mineral water, soft drinks or the like.

Closing caps for containers are known in the prior art, in particular caps intended for containers that have an opening in a neck provided with an outer threaded portion, comprising a lower ring configured to be coupled to the neck of the container and an upper cap that has on the inner face thereof a thread configured to be coupled to the outer threaded portion of a container neck. The upper cap and the lower ring are hinged to one another by means of a hinged portion, such that the upper cap can ascend along the threaded portion of the neck while the lower ring remains in its original position in order not to separate the closing system of the container with respect to the container itself. An example of this type of cap is disclosed in documents no. ES 1247151 and no. ES 1237189.

However, due to the design of concentric rings and the design of the hinged section, it requires relatively complex injection moulds and injection cycles greater than those of other caps, since it is necessary to have multiple mobile mechanisms and sliders that act during the manufacturing cycle, especially due to the complexity of the process for removing the piece from the mould once injected. Consequently, the manufacturing costs for caps of this type are more expensive. Therefore, there is a need to develop a cap for containers that solves the problems raised.

Similar caps are also known where the lower ring is formed by two rings located one above the other, so that the incorporation of caps of this type in the containers does not allow the height of the neck to be reduced, and consequently, does not allow the amount of material intended for the manufacture of the container to be reduced, an aspect that is currently desired in this sector for environmental purposes. Furthermore, this height can also be negatively affected by the arrangement of the breaking points that act as a tamper-evident seal, which further favour a greater height of the lower ring.

Furthermore, the applicant is currently unaware of an invention that has all the features described in this specification.

DESCRIPTION OF THE INVENTION

The present invention has been developed with the aim of providing a closing cap which is configured as a novelty within the field of application and solves the previously mentioned drawbacks, further contributing other additional advantages which will be obvious from the description below.

An object of the present invention is therefore to provide a closing cap for containers, in particular intended for containers that have an opening in a neck provided with an outer threaded portion, being of the type comprising a lower ring configured to be coupled to the neck of the container and an upper cap that has on the inner face thereof a thread configured to be coupled to the outer threaded portion of a container neck, the upper cap and the lower ring being joined to each other in such a way that they are able to rotate together.

In particular, the invention is characterised by the fact that the connection between the upper cap and the lower ring is carried out by means of two extensions with a certain degree of flexibility that are diametrically opposed to each other, each one of them formed from a thickening present in the lower ring that includes a grooved portion such that the extensions are formed above the grooved portion, in such a way that the two extensions have the same outer diameter as the outer diameter of the thickening, the lower edge of the body of the upper cap having a step that defines a recessed portion in which the extensions are located, such that in a closed condition both extensions are arranged above and parallel to the body of the lower ring, while in an open position of the closing cap, the upper end of the extensions acts as a hinge region in such a way that the cap is able to rotate.

Due to the previously defined arrangement, the cap is able to have great freedom of movement and can easily ascend along the threaded portion of the neck during unscrewing, without suffering resistance in the opposite direction. Likewise, in an open position of the closing cap, the lateral extensions remain away from the outer thread of the container neck, providing great freedom of movement to the cap, without any kind of stress, making it easier for the user to position and centre the cap on the container mouth, necessary to properly thread the cap during the action of closing the container.

With this new configuration, it is also possible to reduce the amount of material needed to manufacture the lower ring of the closing cap, making it possible to have a lower height than the rings of the caps developed to remain joined to the container once unscrewed, which implies reduced manufacturing costs.

On the other hand, the manufacturing process is also enhanced by using injection moulds where slider and removal systems of a certain complexity are not required, since the hinge area that other caps of the prior art have is eliminated. It should be noted that using simpler manufacturing means helps to reduce the injection cycle.

In addition, another no less important aspect of the closing cap of the invention is that it does not cause problems (such as friction with the side walls of the channels through which the caps circulate) in the cap feed lines during the automated placement thereof in containers, since portions of the cap with a diameter defined by the upper cap and lower ring do not protrude.

Furthermore, this design allows the flexing area of the extensions to be at a greater height than the flexing area that is created when a horizontal cut is made in the lower ring, so that the unscrewing path that the cap must follow is shorter and the user requires less handling time.

According to another aspect of the invention, stop means are provided which are intended to keep the upper cap fixed in an inverted position with respect to the arrangement taken on by the upper cap during the closed position.

Preferably, the stop means may comprise a projection protruding from the lower ring, which is aligned in height with a tab protruding laterally from the lower edge of the upper cap, such that, in an open condition, the tab abuts a lower surface of the projection, in which the tab has a curved path that can be adapted to the radius of curvature of the lower ring.

The interior of the lower ring includes retaining means intended to act on a perimeter projection present on a container neck, such retaining means being present partially along the inner diameter of the body of the lower ring, in such a way that the regions aligned in height with the position where each of the extensions is generated from the lower ring are devoid of such retaining means. In this way, vertical movement is provided to the lower ring in said devoid areas, such that it reduces the stresses generated in the extensions, favouring the freedom of vertical movement and use of the closing cap, especially when the user wants to screw the cap back onto the container.

Preferably, the retention means comprise a plurality of protuberances aligned and equidistant from each other, which run parallel to the lower edge of the upper cap.

Furthermore, the closing cap of the invention may include a tamper-evident seal between the upper cap and the lower ring.

Preferably, the tamper-evident seal is made up of a plurality of break points distributed in a slot between the lower edge of the upper cap and the upper edge of the lower ring.

According to another advantageous aspect of the invention, the closing cap is made from a single piece of injection-mouldable or compression-moulded plastic material. This cap can leave the moulding area completely finished, so it does not require further processing, which reduces manufacturing costs and time.

Thus, the closing cap described represents an innovative structure with structural and constituent features heretofore unknown for its intended purpose, reasons which, taken together with its usefulness, provide it with sufficient grounds for obtaining the requested exclusivity privilege.

Other features and advantages of the closing cap for containers object of the present invention will be evident in light of the description of a preferred, but not exclusive, embodiment which is illustrated by way of a non-limiting example in the drawings which are attached, wherein:

DESCRIPTION OF A PREFERRED EMBODIMENT

Figure 1:
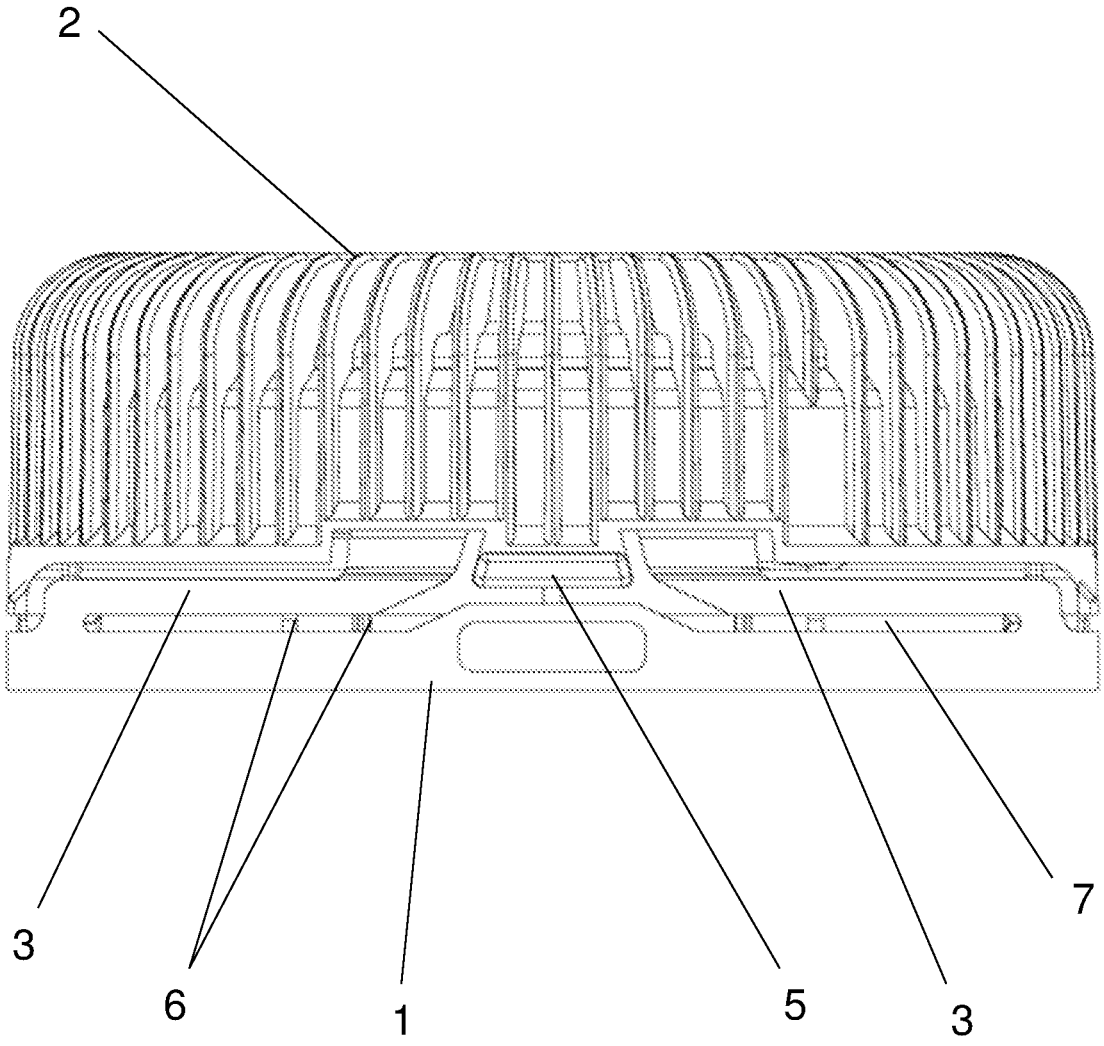
FIG. 1 is a side elevation view of an embodiment of the closing cap according to the present invention.

In light of the aforementioned figures, and in accordance with the adopted numbering, one may observe therein a preferred exemplary embodiment of the invention, which comprises the parts and elements indicated and described in detail below.

Furthermore, the terms first, second, third, and the like in the description and in the claims are used to distinguish between similar items and not necessarily to describe a sequential or chronological order. The terms may be interchanged under appropriate circumstances and the embodiments of the invention may operate in sequences other than those described or illustrated herein.

Furthermore, the terms upper, lower, top, bottom, and the like in the description and in the claims are used for descriptive purposes and not necessarily to describe relative positions.

As can be seen in the figures, the closing cap for containers is intended for containers that have an opening in a neck (100) provided with an outer threaded portion. Said cap is formed by a lower ring (1) configured to be coupled to the neck of the container and an upper cap (2) that has on the inner face thereof a thread (21) configured to be coupled to the outer threaded portion (101) of a container neck (100), the upper cap (2) and the lower ring (1) being joined to each other in such a way that they are able to rotate together around the container neck. This closing cap is made from a single piece of injection-mouldable or compression-moulded plastic material. It should be mentioned that the container neck can have a lower height by using the closing cap described below.

Figure 2:
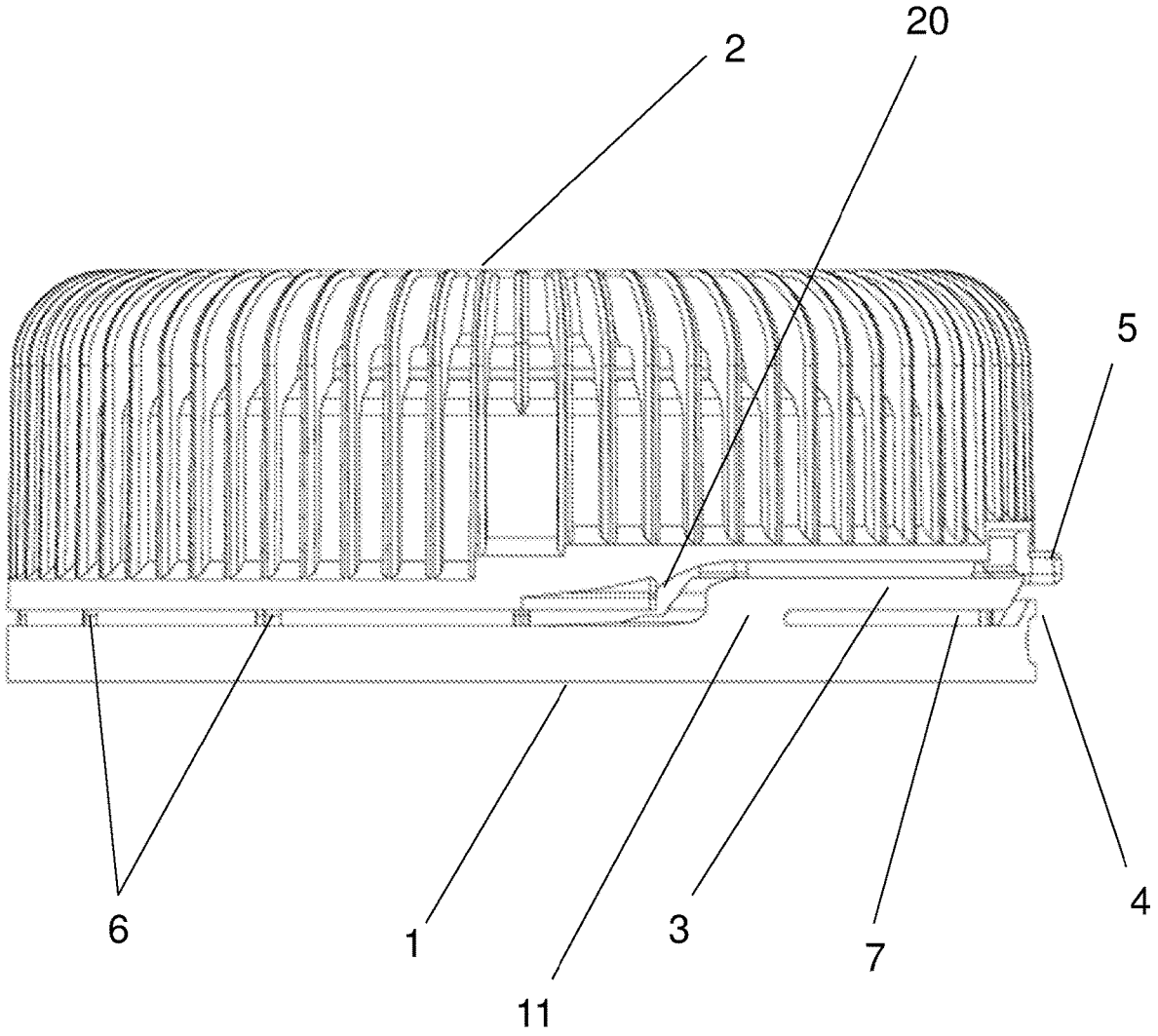
FIG. 2 is another side elevation view of the closing cap shown in FIG. 1.
Figure 3:
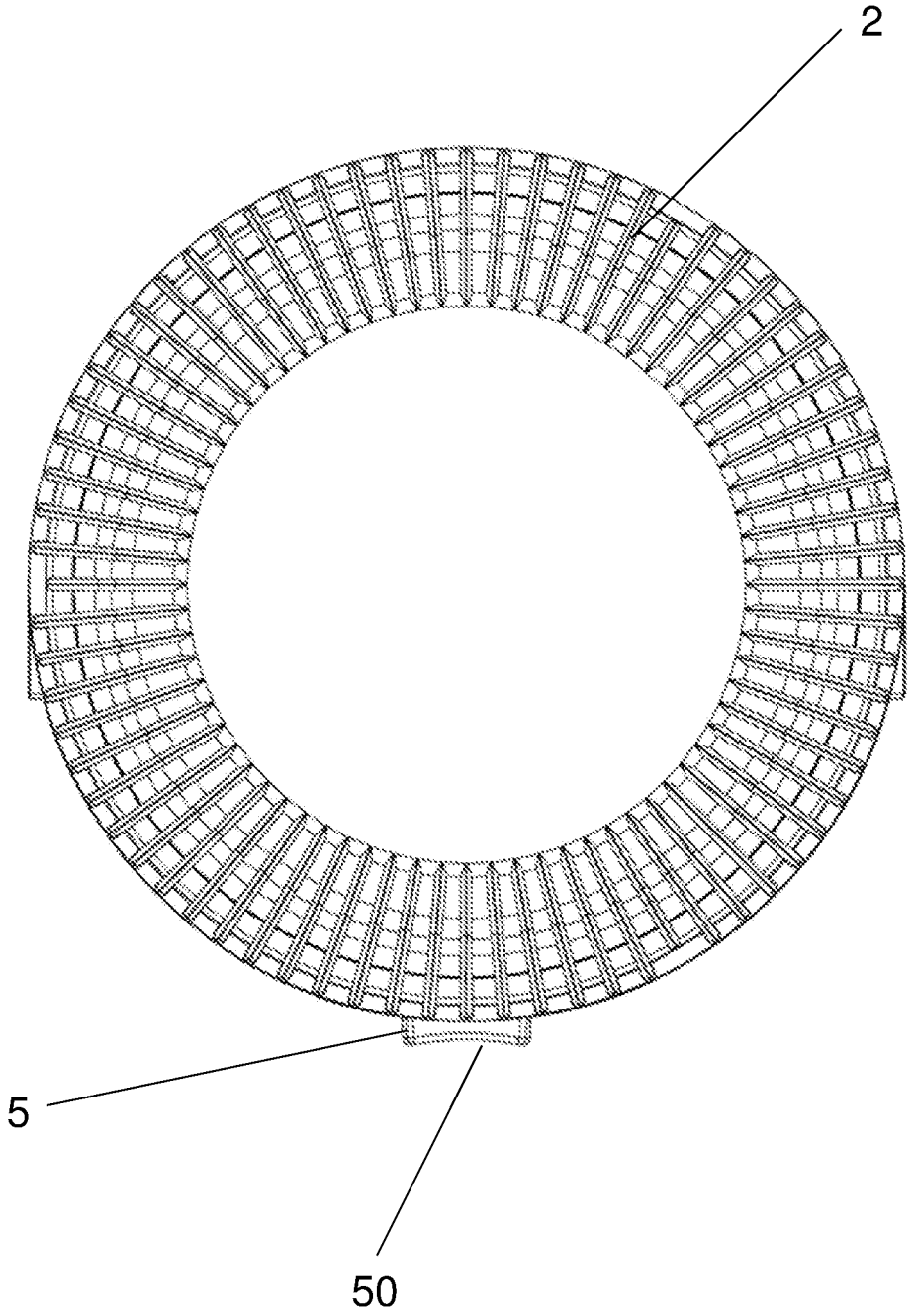
FIG. 3 is a top plan view of the closing cap according to the invention.
Figure 4:
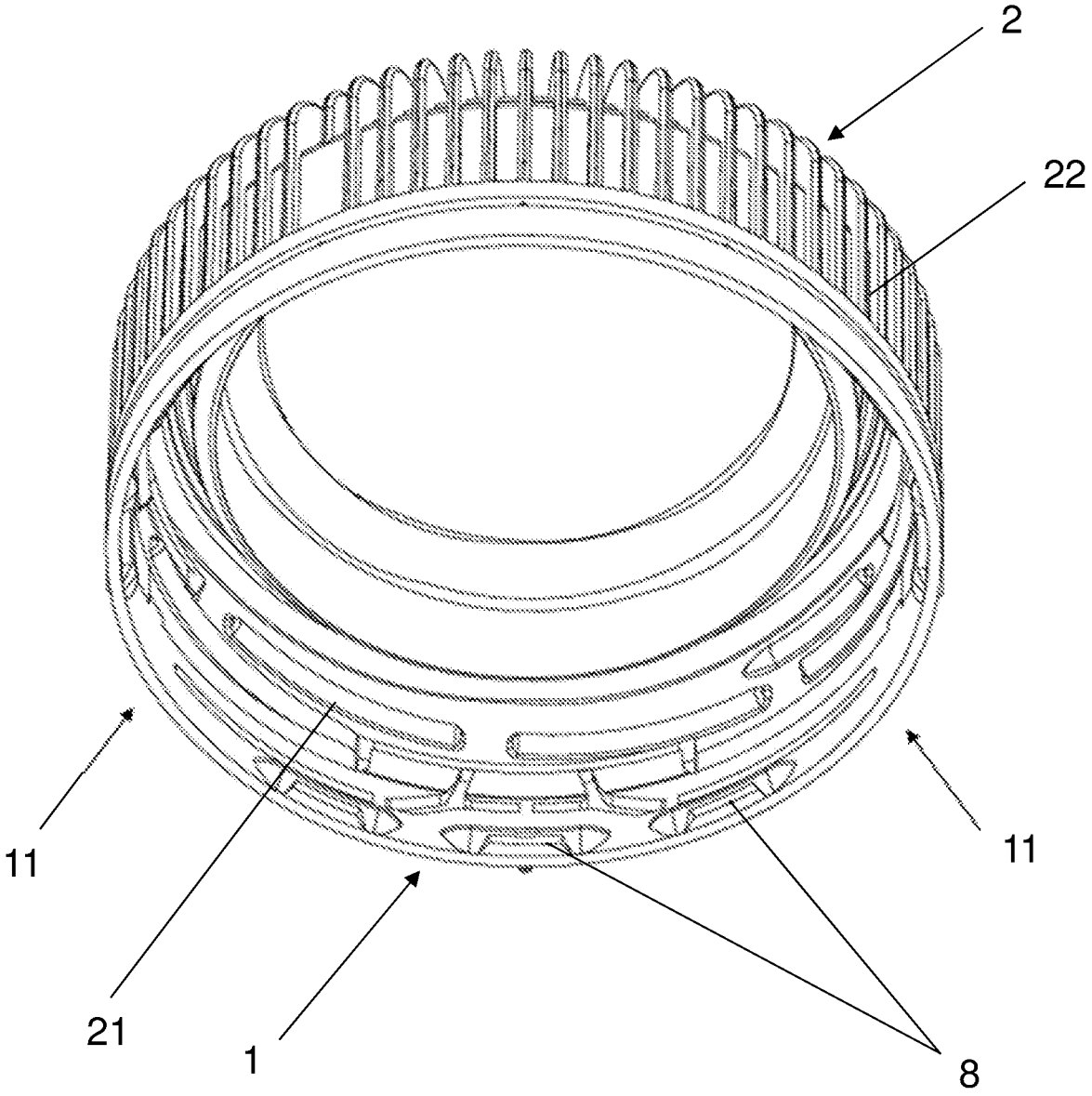
FIG. 4 is a perspective view of the closing cap according to the invention where the inner portion thereof is shown.
Figure 5:
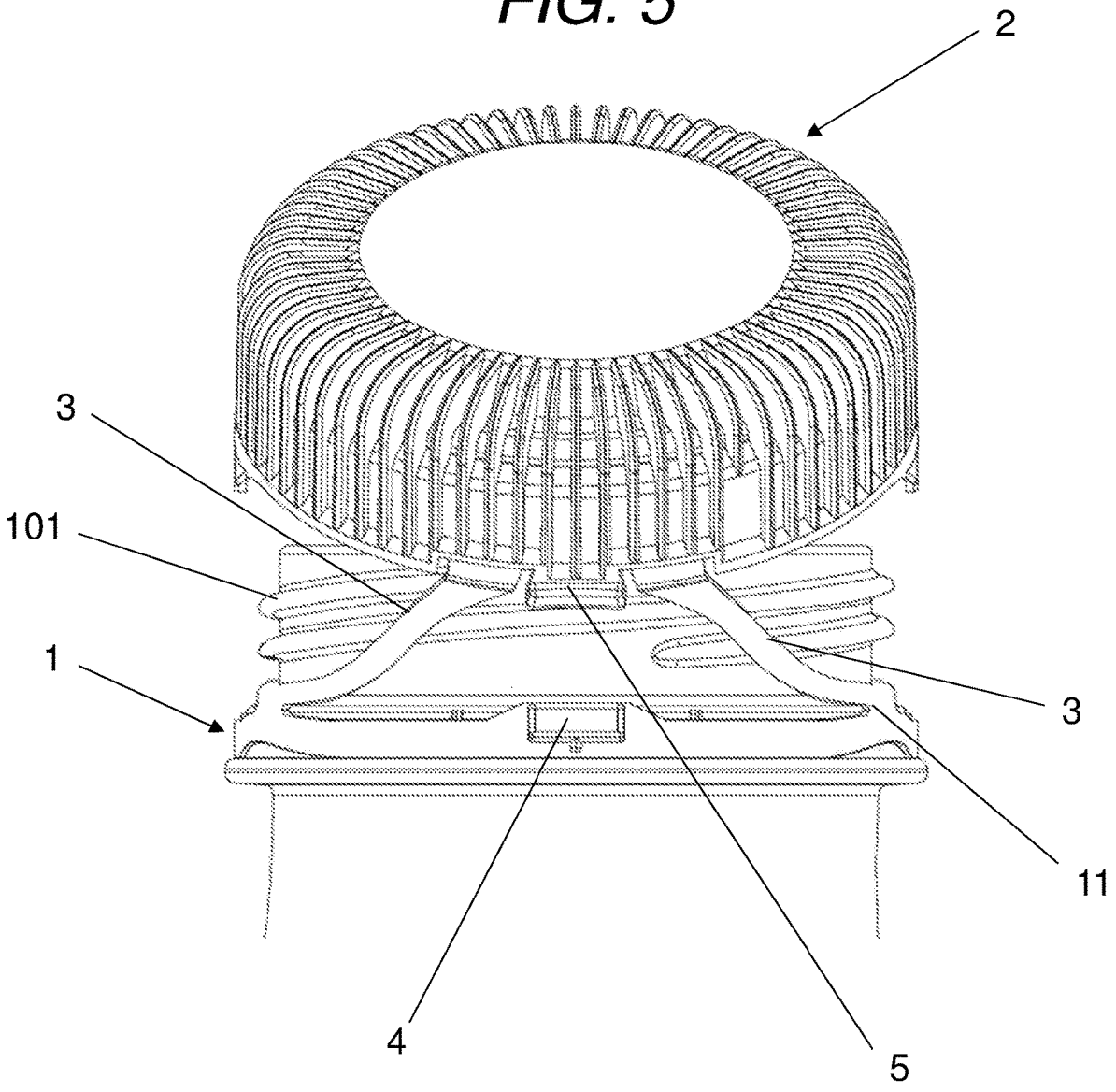
FIG. 5 is a perspective view of the closing cap mounted on a container and in a partially open condition.
Figure 6:
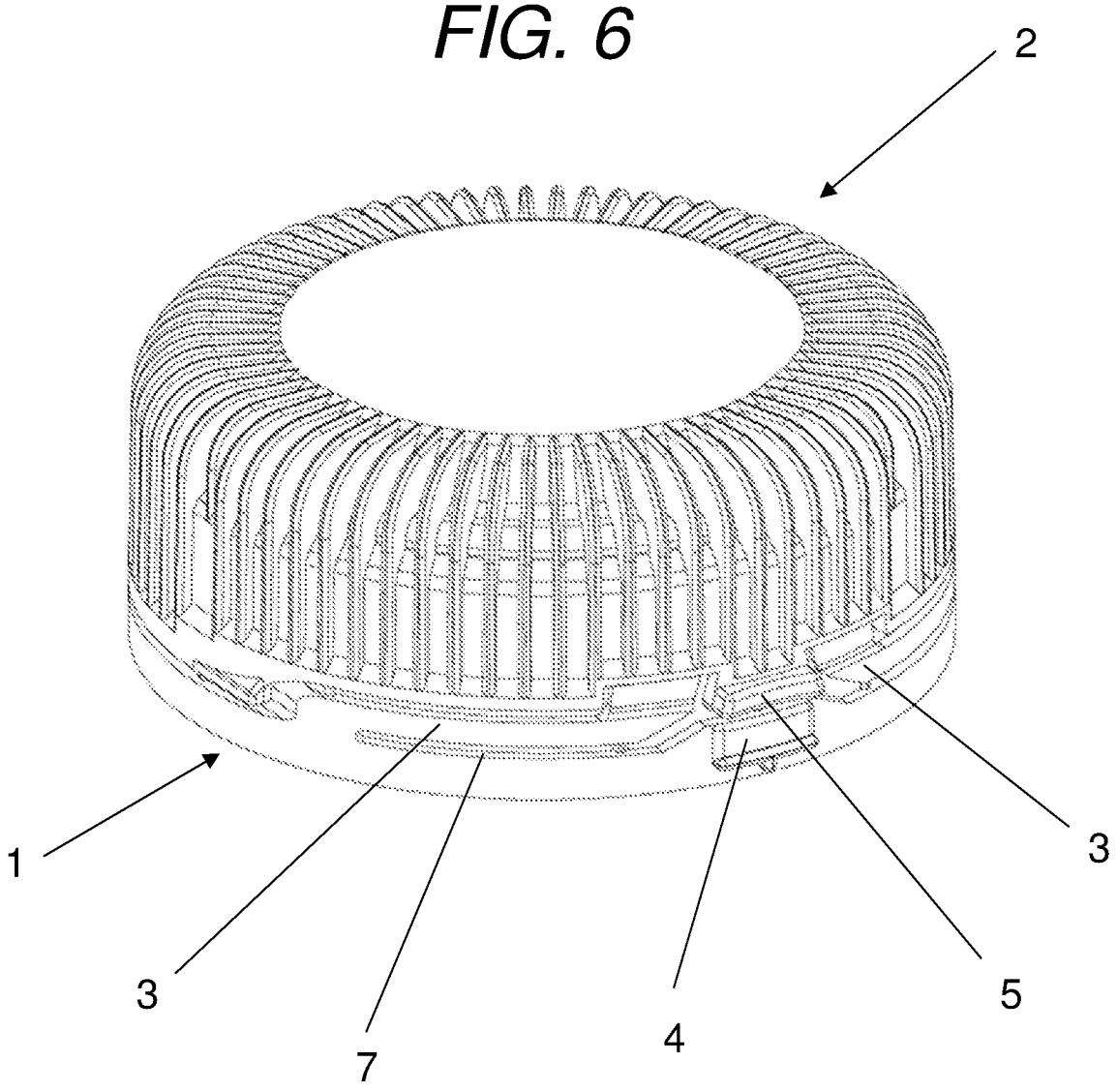
FIG. 6 is a perspective view of the closing cap in a closed condition.
Figure 7:
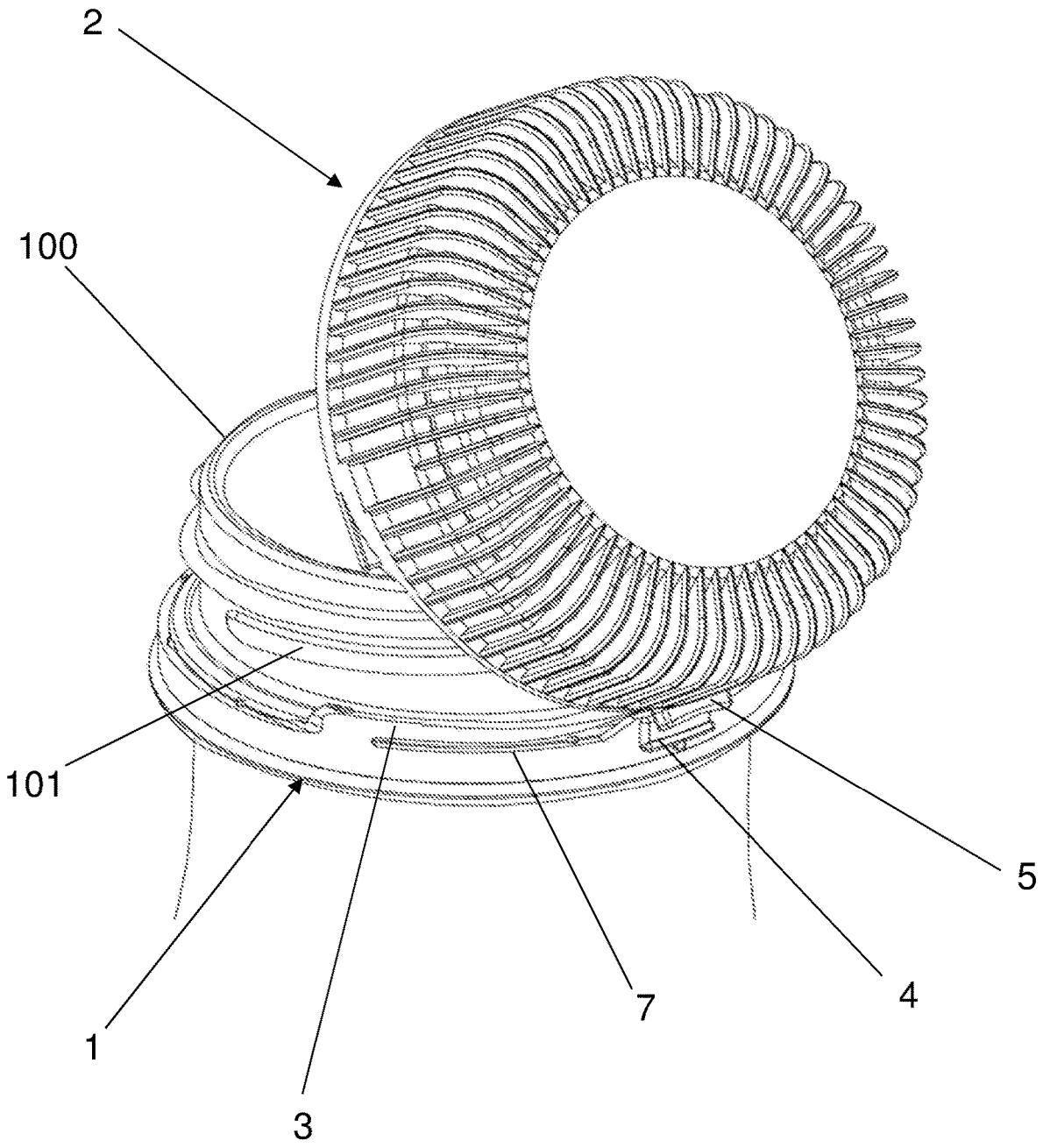
FIG. 7 is a perspective view of the closing cap in a partially open condition.
Figure 8:
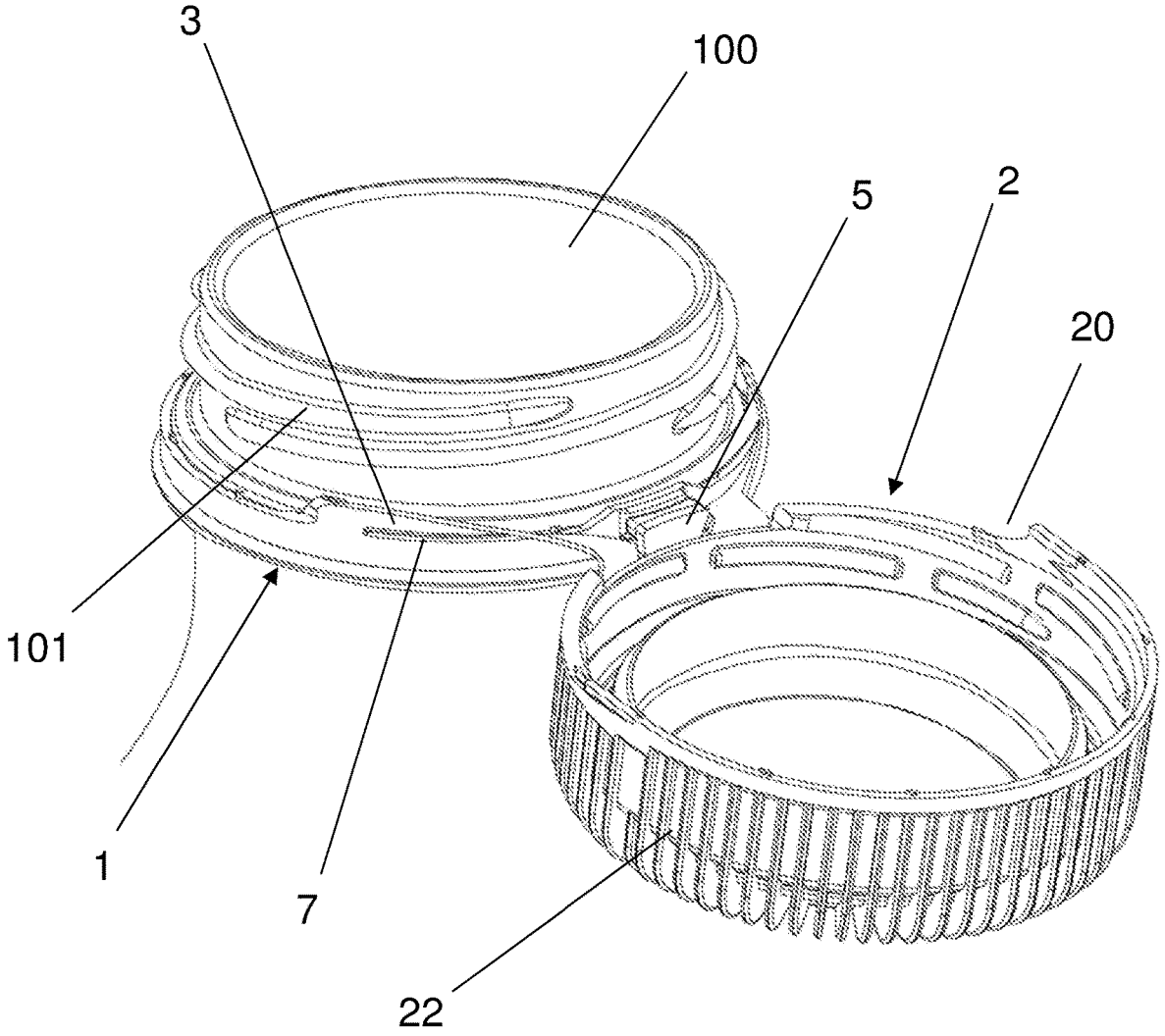
FIG. 8 is a perspective view of the closing cap in a completely open condition.

An outer surface of the lateral face defined by the body of the upper cap (2) has a non-smooth surface (22), in particular, a knurled surface formed by a plurality of ribs in a radial distribution that extend from the upper portion to the lower portion of the body of the upper cap (2), as can be seen in FIGS. 1 to 8.

The connection between the upper cap (2) and the lower ring (1) is carried out by means of two extensions (3) with a certain degree of flexibility and constant cross section, which are diametrically opposed to each other, each one of them formed from a thickening present in the lower ring that includes a grooved portion (7) such that the extensions are formed above the grooved portion (7), in such a way that the two extensions (3) have the same outer diameter as the outer diameter of the thickening, the lower edge of the body of the upper cap (2) having a step (20) that defines a recessed portion in which the extensions (3) are located, such that in an open position of the closing cap, the upper end of the extensions (3) acts as a hinge region in such a way that the upper cap (2) is able to rotate.

In addition, the cap includes stop means intended to keep the upper cap (2) fixed in an inverted position with respect to the arrangement taken on by the upper cap (2) during the closed position.

In particular, these stop means comprise a projection (4) protruding from the lower ring (1), which is aligned in height with a tab (5) protruding laterally from the lower edge of the upper cap (2), such that, in an open condition (FIG. 8), the tab abuts a lower surface of the projection (4), in which the tab (5) has a surface (50) with a curved path that can be adapted to the radius of curvature of the lower ring.

The interior of the lower ring (1) includes retaining means (described below) that are intended to act on a perimeter projection present on a container neck, such retaining means being present partially along the inner diameter of the body of the lower ring (1), in such a way that the regions (11) aligned in height with the position where each of the extensions (3) is generated from the lower ring (1) are devoid of such retaining means.

Referring to the aforementioned retaining means, they comprise a plurality of protuberances (8) aligned and equidistant from each other, which run parallel to the lower edge of the upper cap (2).

To assure the user that the container including the closing cap has not been tampered with, the closing cap includes a tamper-evident seal located between the upper cap (2) and the lower ring (1). This seal is made up of a plurality of break points (6) spaced apart from each other and located between the lower portion of the upper cap (2) and the upper edge of the lower ring (1).

The details, shapes, dimensions and other accessory elements, used to manufacture the closing cap of the invention, may be suitably substituted for others which do not depart from the scope defined by the claims which are included below.

What is claimed is:

1. A closing cap for a container, the container having an opening in a neck provided with an outer threaded portion, the closing cap comprising:

a lower ring coupled to the neck of the container and an upper cap that has on the inner face thereof a thread coupled to the outer threaded portion of a container neck, the upper cap and the lower ring being joined to each other in such a way that they are able to rotate together, wherein the connection between the upper cap and the lower ring is carried out by two flexible extensions that are diametrically opposed to each other, each flexible extension of the two flexible extensions formed from a thickening present in the lower ring that includes a grooved portion such that the two flexible extensions are formed above the grooved portion in such a way that the two flexible extensions have the same outer diameter as the outer diameter of the thickening, the lower edge of the body of the upper cap having a step that defines a recessed portion in which the two flexible extensions are located, and such that in a closed condition the two flexible extensions are arranged above and parallel to the body of the lower ring;

while in an open position of the closing cap, respective upper ends of each flexible extension of the two flexible extensions act as a hinge region in such a way that the upper cap is able to rotate, and in which the interior of the lower ring includes retaining means intended to act on a perimeter projection present on a container neck, such retaining means being disposed on the inner diameter of the body of the lower ring, in such a way that the regions are aligned in height with the position where each flexible extension of the two flexible extensions is generated from the lower ring are devoid of such retaining means such that the two flexible extensions flex responsive to a vertical movement of the lower ring.

2. The closing cap according to claim 1, wherein the closing cap includes stop means intended to keep the upper cap fixed in an inverted position with respect to the arrangement taken on by the upper cap during the closed position.

3. The closing cap according to claim 2, wherein the stop means comprises a projection protruding from the lower ring, which is aligned in height with a tab protruding laterally from the lower edge of the upper cap, and wherein, in an open condition, the tab abuts a lower surface of the projection, in which the tab has a curved path that can be adapted to the radius of curvature of the lower ring.

4. The closing cap according to claim 1, wherein the retaining means comprise a plurality of protuberances aligned and spaced from each other, which run parallel to the lower edge of the upper cap.

5. The closing cap according to claim 1, further comprising a tamper-evident seal between the upper cap and the lower ring.

6. The closing cap according to claim 5, wherein the tamper-evident seal is made up of a plurality of break points distributed in a slot between the lower edge of the upper cap and the upper edge of the lower ring.

7. The closing cap according to claim 1, wherein the closing cap is made up of a single piece of injection-mouldable or compression-moulded plastic material.

8. A closing cap for a container, the container having an opening in a neck provided with an outer threaded portion, the closing cap comprising:

a lower ring coupled to the neck of the container and an upper cap that has on the inner face thereof a thread coupled to the outer threaded portion of a container neck, the upper cap and the lower ring being joined to each other in such a way that they are able to rotate together, wherein the connection between the upper cap and the lower ring is carried out by two flexible extensions that are diametrically opposed to each other, each flexible extension of the two flexible extensions formed from a thickening present in the lower ring that includes a grooved portion such that the two flexible extensions are formed above the grooved portion in such a way that the two flexible extensions have the same outer diameter as the outer diameter of the thickening, the lower edge of the body of the upper cap having a step that defines a recessed portion in which the two flexible extensions are located, and such that in a closed condition the two flexible extensions are arranged above and parallel to the body of the lower ring;

while in an open position of the closing cap, respective upper ends of each flexible extension of the two flexible extensions act as a hinge region in such a way that the upper cap is able to rotate, and in which the interior of the lower ring includes retaining means intended to act on a perimeter projection present on a container neck, such retaining means aligned and equidistant from each other along the inner diameter of the body of the lower ring, except in regions aligned in height with the position where each flexible extension of the two flexible extensions is generated from the lower ring whereby the regions aligned in height are devoid of such retaining means to which the two flexible extensions flex responsively.

9. The closing cap according to claim 8, wherein the closing cap includes stop means intended to keep the upper cap fixed in an inverted position with respect to the arrangement taken on by the upper cap during the closed position.

10. The closing cap according to claim 9, wherein the stop means comprises a projection protruding from the lower ring, which is aligned in height with a tab protruding laterally from the lower edge of the upper cap, and wherein, in an open condition, the tab abuts a lower surface of the projection, in which the tab has a curved path that can be adapted to the radius of curvature of the lower ring.

11. The closing cap according to claim 8, wherein the retaining means comprise a plurality of protuberances aligned and spaced from each other, which run parallel to the lower edge of the upper cap.

12. The closing cap according to claim 8, further comprising a tamper-evident seal between the upper cap and the lower ring.

13. The closing cap according to claim 12, wherein the tamper-evident seal is made up of a plurality of break points distributed in a slot between the lower edge of the upper cap and the upper edge of the lower ring.

14. The closing cap according to claim 8, wherein the closing cap is made up of a single piece of injection-mouldable or compression-moulded plastic material.

* * * * *